US006229258B1

(12) United States Patent
Xia

(10) Patent No.: US 6,229,258 B1
(45) Date of Patent: May 8, 2001

(54) FOCUSING ELECTRODE FOR FIELD EMISSION DISPLAYS AND METHOD

(75) Inventor: Zhongyi Xia, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/653,770

(22) Filed: Sep. 1, 2000

Related U.S. Application Data

(62) Division of application No. 09/085,333, filed on May 26, 1998.

(51) Int. Cl.[7] ..... H01J 29/00

(52) U.S. Cl. ..... 313/495; 313/308; 313/326; 345/47

(58) Field of Search ..... 313/495, 497, 313/306, 307, 308, 326; 345/30, 47, 74, 75

(56) References Cited

U.S. PATENT DOCUMENTS

| | | | |
|---|---|---|---|
| 3,500,102 | 3/1970 | Crost et al. | 313/109 |
| 3,753,022 | 8/1973 | Fraser, Jr. | 313/78 |
| 4,940,916 | 7/1990 | Borel et al. | 313/306 |
| 5,129,850 | 7/1992 | Kane et al. | 445/24 |
| 5,191,217 | 3/1993 | Kane et al. | 250/423 |
| 5,212,426 | 5/1993 | Kane | 315/169.1 |
| 5,359,256 | 10/1994 | Gray | 313/169 |
| 5,475,280 | 12/1995 | Jones et al. | 313/309 |
| 5,491,376 | 2/1996 | Levine et al. | 313/495 |
| 5,508,584 | 4/1996 | Tsai et al. | 313/497 |
| 5,528,103 | 6/1996 | Spindt et al. | 313/497 |
| 5,541,478 | 7/1996 | Troxell et al. | 313/497 |
| 5,850,120 * | 12/1998 | Okamoto | 313/307 X |
| 6,002,204 * | 12/1999 | Beeteson et al. | 313/495 |

FOREIGN PATENT DOCUMENTS

| | | | |
|---|---|---|---|
| 0 527 240 A1 | 2/1993 | (EP) | H01J/63/06 |
| 0 635 865 A1 | 1/1995 | (EP) | H01J/31/12 |
| 61-088432 | 5/1986 | (JP) | H01J/31/15 |
| 62-290050 | 12/1987 | (JP) | H01J/31/15 |

OTHER PUBLICATIONS

Lee, Kon Jiun, "Current Limiting of Field Emitter Array Cathodes," doctoral dissertation Georgia, Institute of Technology, Georgia, Aug. 1986, p. 162.

K. Yokoo et al., "Active Control of Emission Current of Field Emitter Array." Research Institute of Electrical Communication, Tohoku University, Sendai, Japan, Mar.–Apr. 1994, pp. 58–61.

* cited by examiner

*Primary Examiner*—Ashok Patel
(74) *Attorney, Agent, or Firm*—Dorsey & Whitney LLP

(57) ABSTRACT

A display includes a substrate and an emitter formed on the substrate. A first dielectric layer is formed on the substrate to have a thickness slightly less than a height of the emitter above the planar surface and includes an opening formed about the emitter. The display also includes a conductive extraction grid formed on the first dielectric layer. The extraction grid includes an opening surrounding the emitter. The display further includes a second dielectric layer formed on the extraction grid and a focusing electrode formed on the second dielectric layer. The focusing electrode is electrically coupled to the emitter through an impedance element. The focusing electrode includes an opening formed above the apex. The focusing electrode provides enhanced focusing performance together with reduced circuit complexity, resulting in a superior display.

4 Claims, 8 Drawing Sheets

FOCUSING ELECTRODE FOR FIELD EMISSION DISPLAYS AND METHOD

CROSS-REFERENCE TO RELATED APPLICATION

This application is a divisional of U.S. patent application Ser. No. 09/085,333, filed May 26, 1998.

GOVERNMENT RIGHTS

This invention was made with government support under Contract No. DABT63-93-C-0025 awarded by Advanced Research Projects Agency (ARPA). The government has certain rights in this invention.

TECHNICAL FIELD

This invention relates in general to visual displays for electronic devices and in particular to improved focusing electrodes and techniques for field emission displays.

BACKGROUND OF THE INVENTION

FIG. 1 is a simplified side cross-sectional view of a portion of a field emission display 10 including a faceplate 20 and a baseplate 21 in accordance with the prior art. FIG. 1 is not drawn to scale. The faceplate 20 includes a transparent viewing screen 22, a transparent conductive layer 24 and a cathodoluminescent layer 26. The transparent viewing screen 22 supports the layers 24 and 26, acts as a viewing surface and as a wall for a hermetically sealed package formed between the viewing screen 22 and the baseplate 21. The viewing screen 22 may be formed from glass. The transparent conductive layer 24 may be formed from indium tin oxide. The cathodoluminescent layer 26 may be segmented into localized portions. In a conventional monochrome display 10, each localized portion of the cathodoluminescent layer 26 forms one pixel of the monochrome display 10. Also, in a conventional color display 10, each localized portion of the cathodoluminescent layer 26 forms a green, red or blue sub-pixel of the color display 10. Materials useful as cathodoluminescent materials in the cathodoluminescent layer 26 include $Y_2O_3$:Eu (red, phosphor P-56), $Y_3(Al, Ga)_5O_{12}$:Tb (green, phosphor P-53) and $Y_2(SiO_5)$:Ce (blue, phosphor P-47) available from Osram Sylvania of Towanda Pa. or from Nichia of Japan.

The baseplate 21 includes emitters 30 formed on a planar surface of a substrate 32 that is preferably a semiconductor material such as silicon. The substrate 32 is coated with a dielectric layer 34. In one embodiment, this is effected by deposition of silicon dioxide via a conventional TEOS process. The dielectric layer 34 is formed to have a thickness that is approximately equal to or just less than a height of the emitters 30. This thickness is on the order of 0.4 microns, although greater or lesser thicknesses may be employed. A conductive extraction grid 38 is formed on the dielectric layer 34. The extraction grid 38 may be formed, for example, as a thin layer of polysilicon. An opening 40 is created in the extraction grid 38 having a radius that is also approximately the separation of the extraction grid 38 from the tip of the emitter 30. The radius of the opening 40 may be about 0.4 microns, although larger or smaller openings 40 may also be employed.

In operation, the extraction grid 38 is biased to a voltage on the order of 100 volts, although higher or lower voltages may be used, while the substrate 32 is maintained at a voltage of about zero volts. Signals coupled to the emitters 30 allow electrons to flow to the emitter 30. Intense electrical fields between the emitter 30 and the extraction grid 38 cause emission of electrons from the emitter 30.

A larger positive voltage, ranging up to as much as 5,000 volts or more but usually 2,500 volts or less, is applied to the faceplate 20 via the transparent conductive layer 24. The electrons emitted from the emitter 30 are accelerated to the faceplate 20 by this voltage and strike the cathodoluminescent layer 26. This causes light emission in selected areas, i.e., those areas opposite the emitters 30, and forms luminous images such as text, pictures and the like.

Electrons emitted from each emitter 30 in a conventional field emission display 10 tend to spread out as the electrons travel from the emitter 30 to the cathodoluminescent layer 26 on the faceplate 20. If the electron emission spreads out too far, it will impact on more than one localized portion of the cathodoluminescent layer 26 of the field emission display 10. This phenomenon is known as "bleedover." The likelihood that bleedover may occur is exacerbated by any misalignment between the localized portions of the cathodoluminescent layer 26 and their associated sets of emitters 30.

When the electron emission from an emitter 30 associated with a first localized portion of the cathodoluminescent layer 26 also impacts on a second localized portion of the cathodoluminescent layer 26, both the first and second localized portions of the cathodoluminescent layer 26 emit light. As a result, the first pixel or sub-pixel uniquely associated with the first localized portion of the cathodoluminescent layer 26 correctly turns on, and a second pixel or sub-pixel uniquely associated with the second localized portion of the cathodoluminescent layer 26 incorrectly turns on. In a color field emission display 10, this can cause purple light to be emitted from a blue sub-pixel and a red sub-pixel together when only red light from the red sub-pixel was desired. As a result, a degraded image is formed on the faceplate 20 of the field emission display 10.

In a monochrome field emission display 10, color distortion does not occur, but the resolution of the image formed on the faceplate 20 is reduced by bleedover. In conventional field emission displays 10, bleedover is alleviated in several ways. A relatively high anode voltage $V_a$ may be applied to the transparent conductive layer 24 of the conventional field emission display 10, so that the electrons emitted from the emitters 30 are strongly accelerated to the faceplate 20. As a result, the electron emissions spread out less as they travel from the emitters 30 to the faceplate 20. A relatively small gap between the faceplate 20 and the baseplate 21 may be used, again reducing opportunity for spreading of the emitted electrons. However, it has been found that these are impractical solutions because too high a voltage applied between the transparent conductive layer 24 and the baseplate 21, or too small a gap between the faceplate 20 and the baseplate 21 may cause arcing.

Another way in which bleedover is reduced in conventional field emission displays 10 is by spacing the localized portions of the cathodoluminescent layer 26 relatively far apart. This is possible because of the relatively low display resolution provided by conventional field emission displays 10. As a result, the electron emissions impact on the correct localized portion of the cathodoluminescent layer 26.

Another approach to controlling the spatial spread of electrons emitted from a group of the emitters 30 is to surround the area emitting the electrons with a focusing electrode (not illustrated in FIG. 1). This allows increased control over the spatial distribution of the emitted electrons via control of the voltage applied to the focusing electrode, which in turn provides increased resolution for the resulting image. One such approach, where each focusing element serves many emitters, is described in U.S. Pat. No. 5,528,103, entitled "Field Emitter With Focusing Ridges Situated To Sides Of Gate", issued to Spindt et al.

There are several disadvantages to these prior art approaches. In most prior art approaches, the focusing electrode is biased by a voltage source that is independent of other bias voltage sources associated with the emitter 30. As a result, the use of a focusing electrode generally requires another bias voltage source to bias the focusing electrode. This, in turn, leads to problems due to variations in turn on voltage from one emitter 30 to another when a single bias voltage is applied for several focusing electrodes. When a group of emitters 30 are all affected by a single focusing electrode, some of the emitters 30 may exhibit a turn on voltage that differs from that exhibited by other emitters 30. The effect that the focusing electrode has on the electrons emitted from each of these emitters 30 will differ. Additionally, some of the current through the emitter 30 will be collected by the focusing electrode. This complicates the relationship between the emitter current and light emission because some of the current through the emitter 30 is diverted from the faceplate 20 by the focusing electrode. Further, the effects of the focusing electrode are different for emitters 30 that are closer to the focusing electrode than for emitters 30 that are farther away from the focusing electrode. The lack of control over the amount of light emitted in response to a known emitter current results in poorer imaging characteristics for the display 10.

The problem of bleedover is exacerbated by the trend to higher solution field emission displays 10. High resolution field emission displays use fewer emitters 30 per pixel or sub-pixel. This arises for several reasons, one of which is that a smaller pixel or sub-pixel subtends a smaller area in which the emitters 30 can be provided. As display engineers attempt to increase the display resolution of conventional field emission displays 10, the localized portions of the cathodoluminescent layer 26 are necessarily crowded closer together. As a result, each emitter 30 in a high resolution field emission display makes a greater contribution to the pixel or sub-pixel associated with it. This increases the need to be able to control electron emissions and the spread of electron emissions from each emitter 30.

An approach to focusing electrons emitted from the emitter 30 without requiring a separate bias voltage source to bias the focusing electrode is described in U.S. Pat. No. 5,191,217, entitled "Method and Apparatus for Field Emission Device Electrostatic Electron Beam Focussing," issued to Kane et al. This approach makes no provision for modifying the focus parameters in response to the amount of current through the emitter 30.

There is, therefore, a need to provide more reliable control of the spatial distribution of the electrons delivered to the faceplate without causing other problems in field emission displays.

SUMMARY OF THE INVENTION

In accordance with one aspect of the invention, a field emission display includes a substrate, a plurality of emitters formed on the substrate, and a dielectric layer formed on the substrate having an opening formed about each of the emitters. The field emission display also includes a conductive extraction grid formed substantially in a plane of tips of the plurality of emitters. The extraction grid includes openings each formed about a tip of one of the emitters. In accordance with an aspect of the invention, a focusing electrode that physically confines emitted electrons provides enhanced focusing performance together with reduced circuit complexity compared to prior art approaches. This, in turn, results in superior display performance, especially for high resolution field emission displays.

In another aspect of the invention, a focus electrode is formed on the substrate having an opening positioned above the emitter. An impedance element is electrically coupled between the focus electrode and the emitter. The impedance element allows a portion of those electrons that were emitted from the emitter and that were intercepted by the focus electrode to return to the emitter. The current flow through the impedance element produces a voltage that biases the focus electrode.

DETAILED DESCRIPTION OF THE INVENTION

Figure 1:
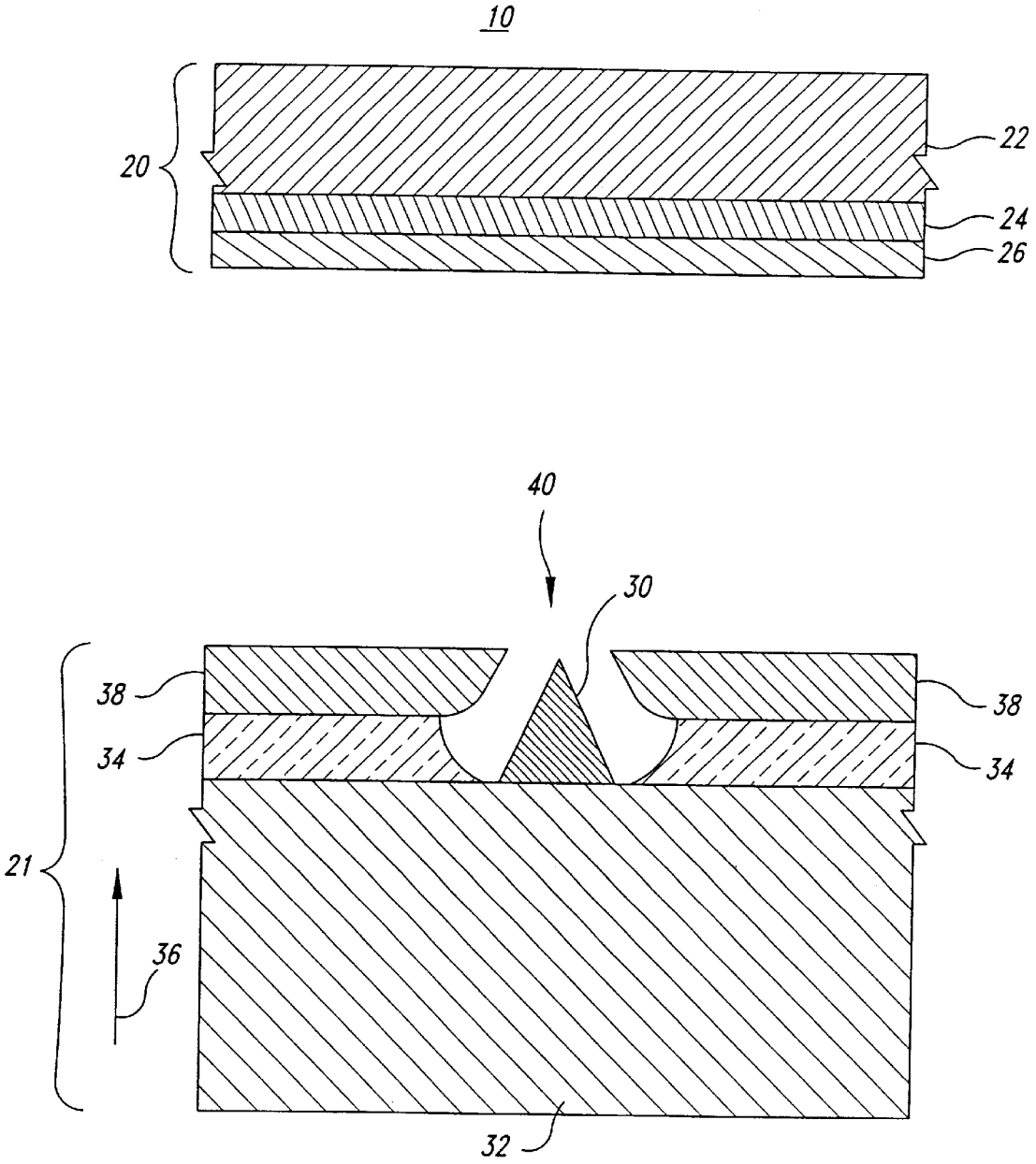
Fig. 1 (PRIOR ART)
FIG. 1 is a simplified side cross-sectional view of a portion of a field emission display according to the prior art.
Figure 2:
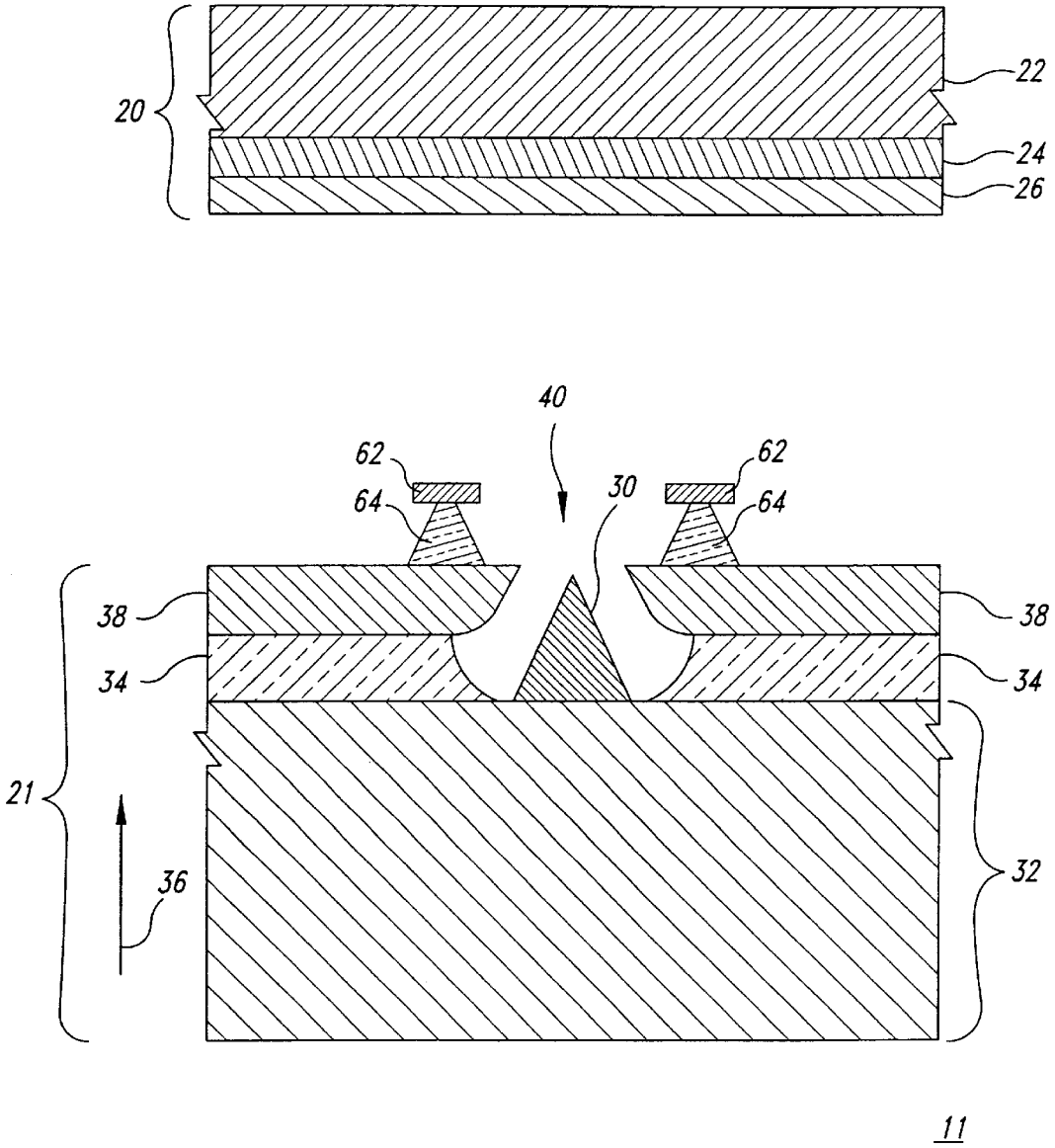
FIG. 2 is a simplified side cross-sectional view of a portion of a field emission display including a focusing electrode according to an embodiment of the invention.

FIG. 2 is a simplified side cross-sectional view of a portion of a field emission display 11 including a focusing electrode 62 in accordance with. one embodiment of the invention. FIG. 2 is not drawn to scale. Many of the components used in the field emission display 11 shown in FIG. 2 are identical to components used in the field emission display 10 of FIG. 1. Therefore, in the interest of brevity, these components have been provided with the same reference numerals, and an explanation of them will not be repeated.

The pattern made by the emitted electrons when they strike the faceplate 20 is optimized by incorporating focusing electrodes 62 into the circuitry associated with the emitter 30. This is particularly desirable for high resolution field emission displays 11. The focusing electrodes 62 may be supported above the extraction grid 38 by a dielectric layer 64 as illustrated or may be placed in the plane of the extraction grid 38 (not illustrated).

Significantly, forming the opening in the focusing electrode 62 smaller than the diameter of the beam of electrons that would be emitted from the emitter 30 if the focusing electrode were not present causes the opening in the focusing electrode 62 to act as a pinhole. In other words, placing the focusing electrode 62 such that it physically confines the electrons emitted from the emitter 30 returns a portion of the emitted electrons to the emitter 30. Under these circumstances, the shape of the electron distribution when the emitted electrons reach the faceplate 20 is determined more by the opening in the focusing electrode 62 than by the geometry of the tip of the emitter 30. This allows a more uniform image to be displayed despite variations in the tips of the emitters 30. This effect results from either making the diameter of the opening in the focusing electrode 62 small placing the focusing electrode 62 at a relatively large distance (e.g., up to five to ten microns) above the extraction grid 38 and the emitters 30.

Figure 3A:
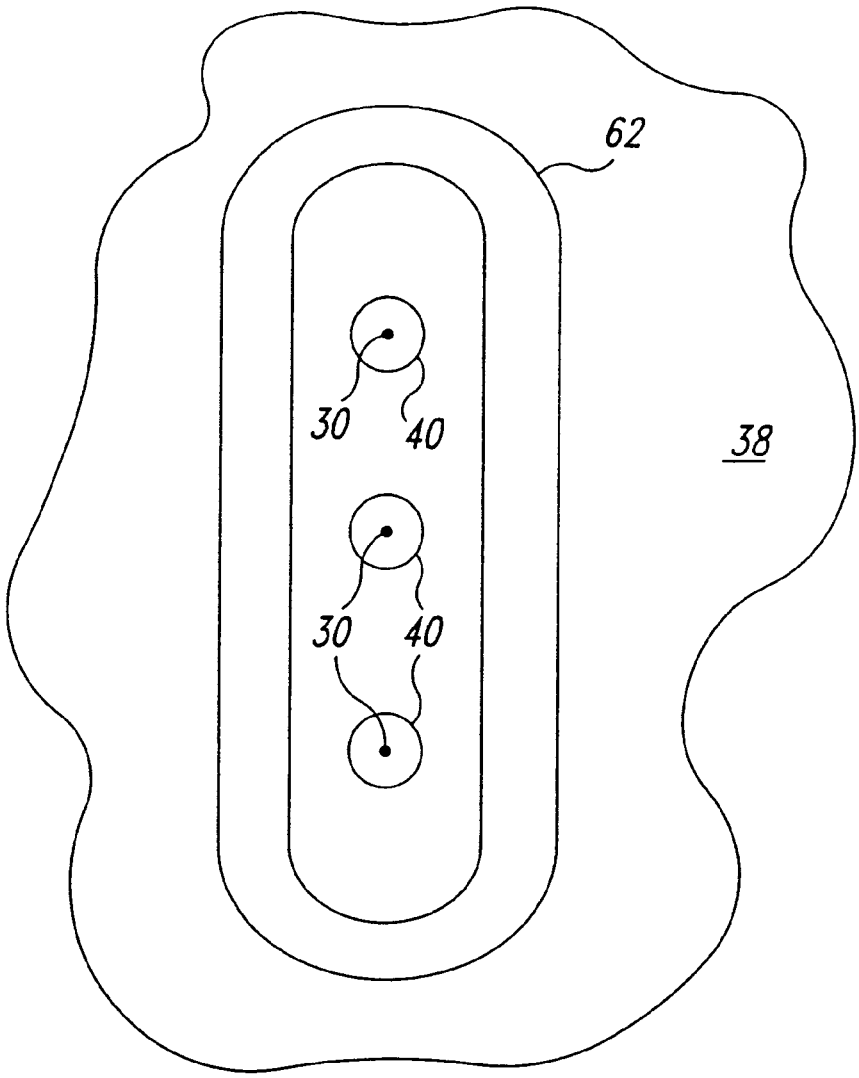
FIGS. 3A, 3B and 3C are a simplified plan views of a portion of a field emission display including a focusing electrode according to embodiments of the invention.
Figure 3B:
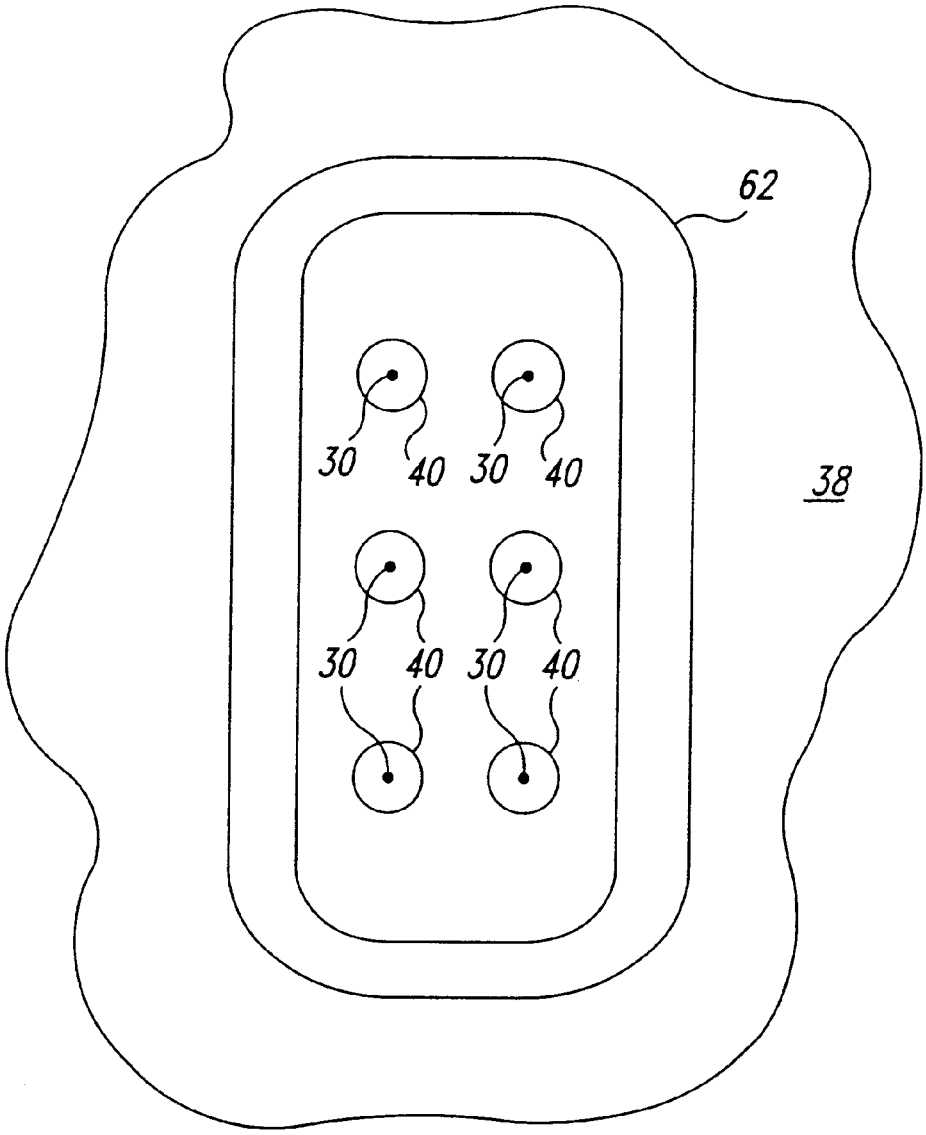
Figure 3C:
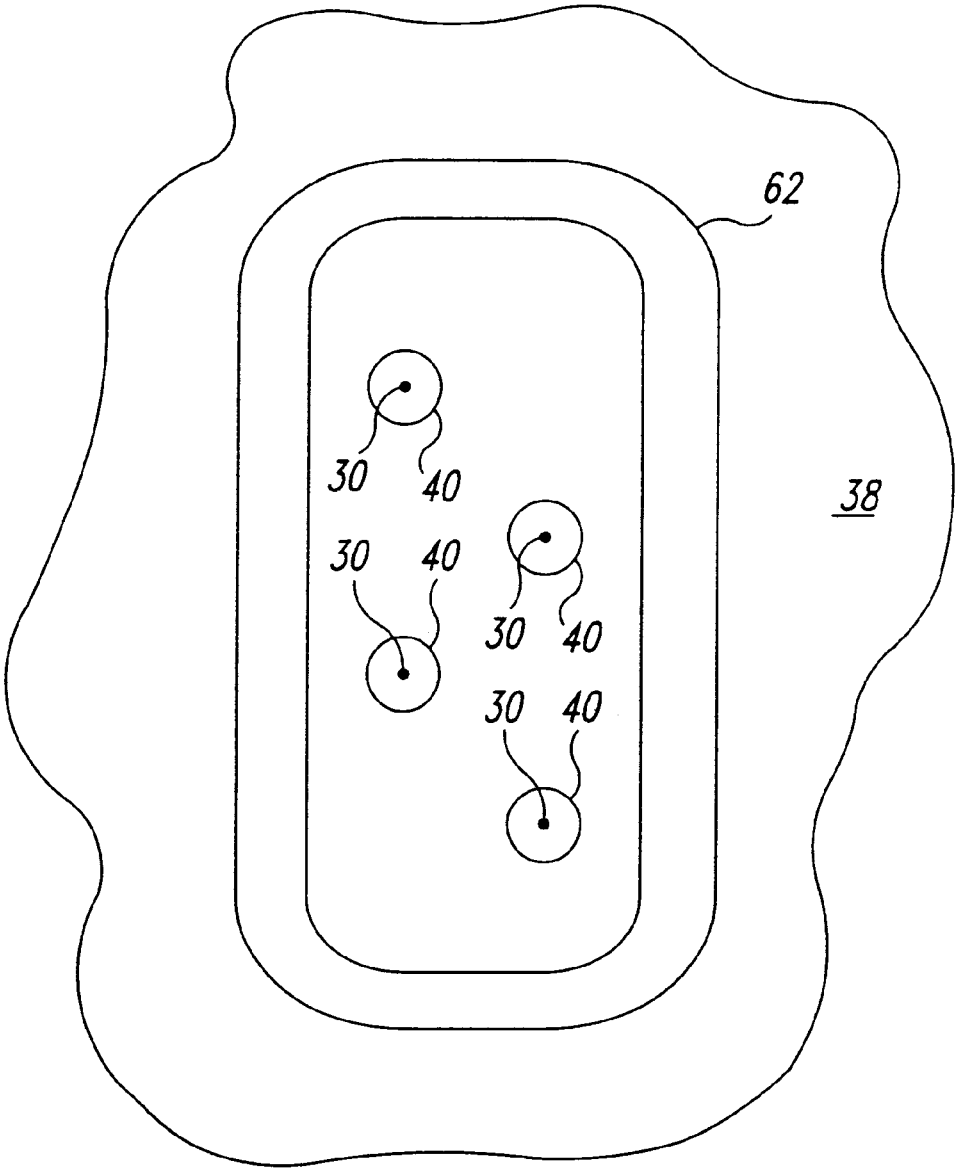

As shown in the simplified plan view of FIG. 3A, a field emission display 11 includes a focusing electrode 62 surrounding a three emitters 30, grouped in a linear array. Three emitters 30 are shown in FIG. 3A for clarity of explanation and ease of illustration, however, it will be appreciated that more or fewer emitters 30 could be associated with a given focus electrode 62, with one to ten emitters 30 being desirable, although more may be employed. The emitters 30 may be arranged in a single line, as shown in FIG. 3A, or may be configured in a double line as shown in FIG. 3B or may be staggered in a double line of emitters 30 as shown in FIG. 3C, or may be in some other configuration. In the embodiments shown in FIGS. 3A through 3C, the focusing electrode 62 is preferably spaced laterally (i.e., left to right in FIGS. 3A through 3C) from the emitters 30 by a micron or more. Edge or end effects are reduced if the ends (i.e., top and bottom) of the focusing electrode 62 are several microns away from those emitters 30 that are located at the ends of the groups of emitters 30.

An advantage provided by a linear array of emitters 30 within an oblong focusing electrode 62 is that the focusing electrode 62 provides a more uniform effect on each of the emitters 30 compared to a focusing electrode surrounding a large group of emitters 30 because the emitters 30 in the group are at different distances from the focus electrode. A field emission display using a focusing electrode to surround a group of emitters is described, for example, in U.S. Pat. No. 5,528,103. The uniformity of the linear arrangements shown in FIGS. 3A through 3C renders the focusing electrodes 62 more effective.

A linear arrangement is preferred for several reasons. First, emitters in other arrangements may function differently depending upon their location. Furthermore, a focusing electrode optimized for one electrode may not be optimized for other emitters in the group. In contrast, the emitters 30 shown in FIGS. 3A–3C are all the same distance from a focusing electrode 62 and the focus influence thus should be similar for each of the emitters 30.

Figure 4:
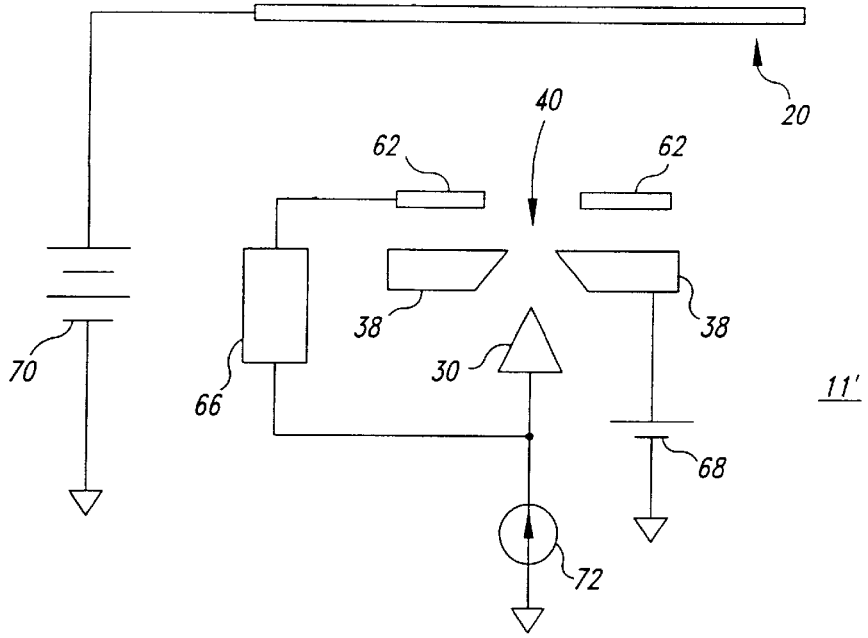
FIG. 4 is a simplified schematic view of a field emission display and one emitter and focusing electrode biasing arrangement according to an embodiment of the invention.

FIG. 4 is a simplified schematic view of one embodiment of a field emission display 11' in accordance with the invention having the emitter 30 electrically coupled via an optional impedance 66 to the focusing electrode 62. The focusing electrode 62 is formed above the extraction grid 38 as described above with reference to FIG. 2. A bias voltage is applied to the extraction grid 38 via a power supply 68, and a bias voltage is supplied to the faceplate 20 via a power supply 70. In this embodiment, the electrons supplied to the emitter 30 are modulated by a current source 72, such as the FET 50 of FIG. 1.

By electrically coupling a focusing electrode 62 to the emitter 30, several different objectives can be met while also simplifying the biasing arrangements for the emitter 30 and ancillary circuitry. One of these objectives is that the current coupled through the emitter 30 by the current source 72 is proportional to the current through the faceplate 20 because any electrons collected by the focusing electrode 62 are automatically resupplied to the emitter 30 through the optional impedance 66. Many of the prior art arrangements for biasing focusing electrodes permit an undefined amount of the current carried by the emitters to be diverted via the focusing electrodes. This means that the luminosity of the pixel associated with the emitters 30 is not necessarily related to the current that was directed through the emitters 30. Another of these objectives is that there is no need to adjust the bias voltage on the focusing electrode 62 to compensate for variations in the voltage on the emitter 30. Further, there is no need for a separate bias voltage source for the focusing electrode 62.

Figure 5:
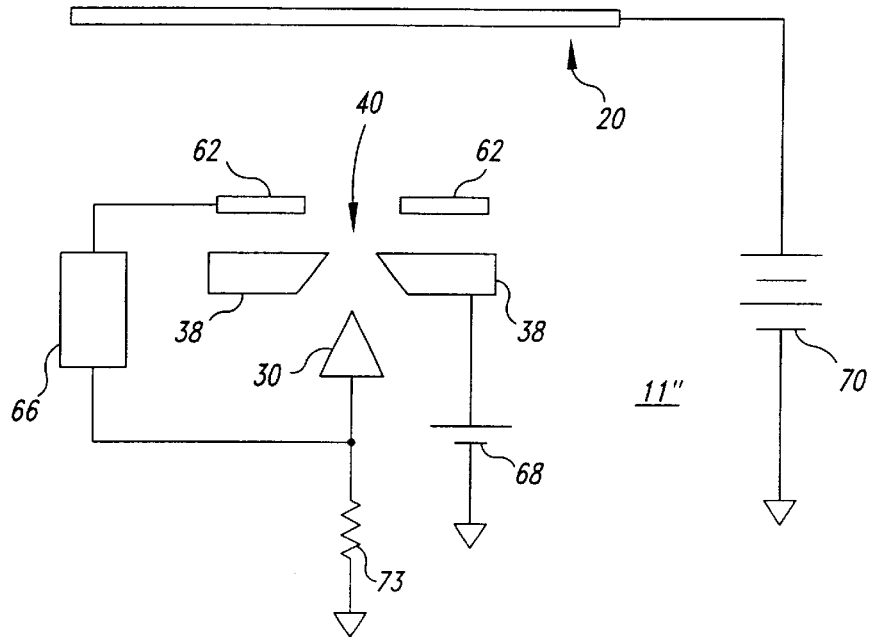
FIG. 5 is a simplified schematic view of a field emission display and another emitter and focusing electrode biasing arrangement according to another embodiment of the invention.

FIG. 5 is a simplified schematic view of another embodiment of a field emission display 11" in accordance with the invention. In the display 11" electrons are supplied to the emitter 30 via a current-limiting element, such as a resistor 73, that is electrically coupled between the emitter 30 and ground. In this approach, the current through the emitter 30 is ultimately set by a bias voltage applied to the extraction grid 38. The arrangement of FIG. 5 is used to permit each emitter 30 to be self-biasing and ensures that if one or more of the emitters 30 become short-circuited, e.g., to the extraction grid 38, the entire pixel is not short-circuited, because the resistor 73 limits the current through any one emitter 30.

In either of the embodiments 11' and 11" of FIGS. 4 and 5, the relationship between the current through the faceplate 20 and the emitter 30 current is simplified compared to the situation where an independent bias voltage source is used to set the voltage on a focusing electrode. In both embodiments 11' and 11", the focusing electrode 62 is electrically coupled to the emitter 30 via the optional impedance 66. This arrangement ensures that the current through the controlled current source 72 is either directed to the extraction grid 38 or is directed through the opening 40 and is collected by the faceplate 20. As a result, the focusing electrode 62 does not provide additional path whereby current flowing through the emitter 30 may be diverted. For the case where the optional impedance 66 is simply an interconnection, the effect of the focusing electrode 62 is readily modeled because the potential on the focusing electrode 62 is exactly the same as the potential on the emitter 30.

When the optional impedance 66 comprises a current-limiting element, such as, for example, a high value resistor, the focusing electrode 62 becomes self-biasing because the electrons collected by the focusing electrode 62 bias the focusing electrode 62 negative with respect to the emitter 30. As the voltage on the focusing electrode becomes more negative, it attracts fewer electrons, thus limiting the voltage on the focusing electrode 62 from becoming even more negative. The use of the impedance 66 does not impair the benefits of not requiring a separate focus power supply and of ensuring that the emitter current corresponds to the luminance. Additionally, a short circuit between the focusing electrode 62 and, for example, the extraction grid 38 (or other structures), need not completely prevent the emitter 30 from functioning, because the impedance 66 isolates the emitter 30 from the focusing electrode 62 to some degree.

It will be appreciated that current-limiting elements other than an impedance 66 may be employed, such as constant current elements (e.g., reverse-biased diodes or FETs having the source connected to the gate) or constant voltage elements (e.g., Zener diodes) and the like, to either provide a bias voltage on the focusing electrode 62 that is related to the emitter 30 current or that has a known relationship to the voltage present on the emitter 30.

In the embodiments of FIGS. 3 through 5, the focusing achieved by the focusing electrode 62 is determined by the geometry and placement of the focusing electrode 62 with respect to the other structures, and especially the emitter 30, forming the field emission display 11, 11' or 11". Both the lateral separation of the focusing electrode 62 from the tips of the emitters 30, typically on the order of one or two micrometers, and the vertical separation of the focusing electrode 62 from the extraction grid 38, may be varied. The vertical separation may range from zero microns when the focusing electrode 62 is placed in the plane of the extraction grid 38 (not illustrated), to one to five microns or even as much as ten microns or more.

Figure 6:
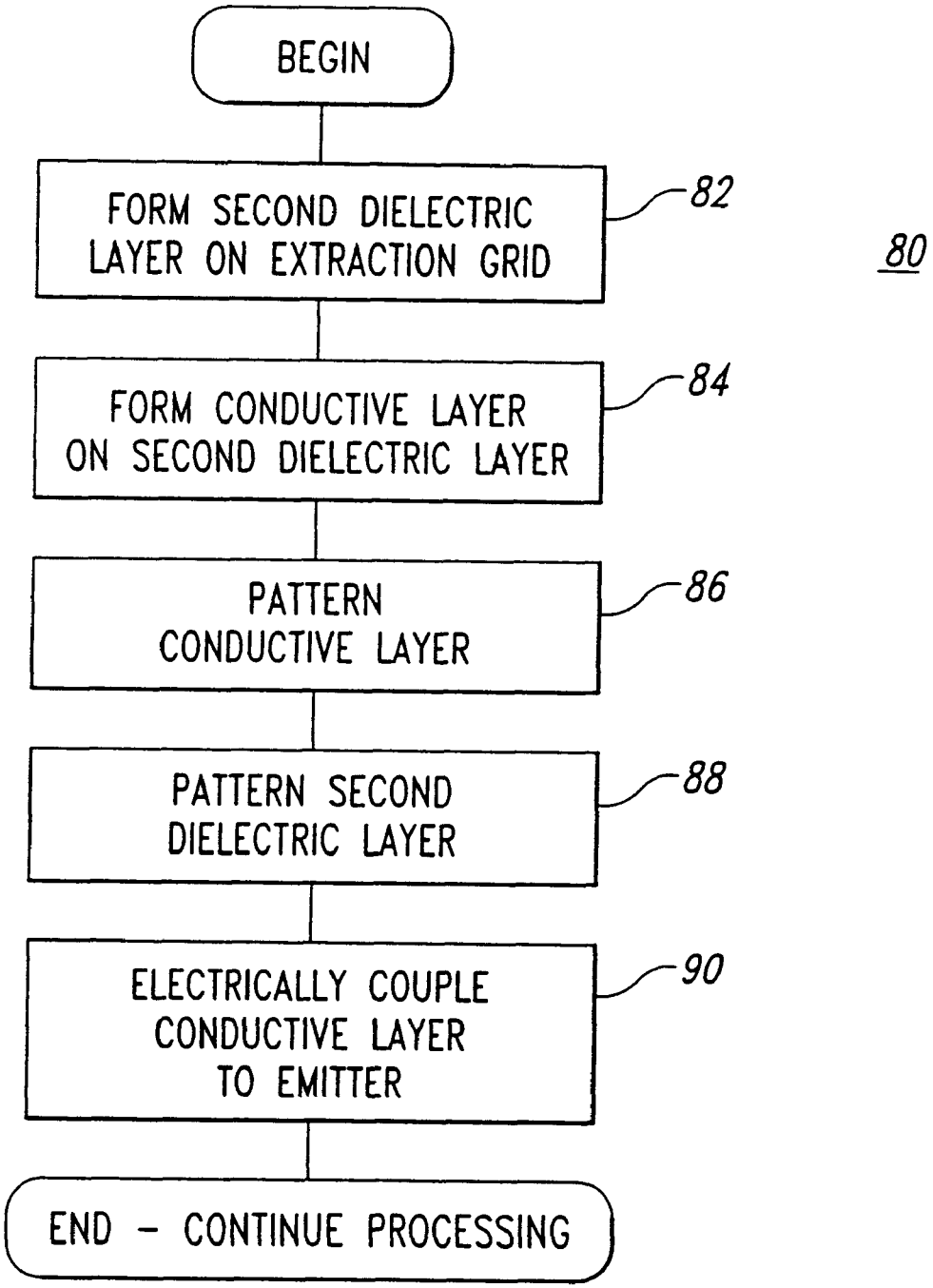
FIG. 6 is a flow chart of a process for manufacturing a focusing electrode according to an embodiment of the present invention.

FIG. 6 is a flow chart of a process 80 for manufacturing the focusing electrode 62 according to an embodiment of the present invention. The substrate 32 having a plurality of the emitters 30 has been previously formed, and the surface of the substrate 32 and the emitters 30 have been previously coated with the dielectric layer 34. The extraction grid 38 has also already been formed. The second dielectric layer 64 is formed on the extraction grid 38 in step 82. A conductive layer is formed on the second dielectric layer 64 in step 84. The conductive layer is patterned to form the focusing electrode 62 in step 86. The second dielectric layer is then patterned in step 88 so as to form an opening surrounding each emitter 30 or group of emitters.

In one embodiment, the conductive layer is formed as a polysilicon layer, and the second dielectric layer 64 is a layer of silicon dioxide deposited on the extraction grid 38. This arrangement allows the second dielectric layer 64 to be patterned via the buffered oxide etch using the focusing electrode 62 as a self-aligned mask. The focusing electrode 62 is electrically coupled to the emitter 30 via the optional impedance 66 in step 90. The process 80 then ends and processing of the field emission display 11, 11' or 11" is subsequently completed via conventional fabrication steps.

Figure 7:
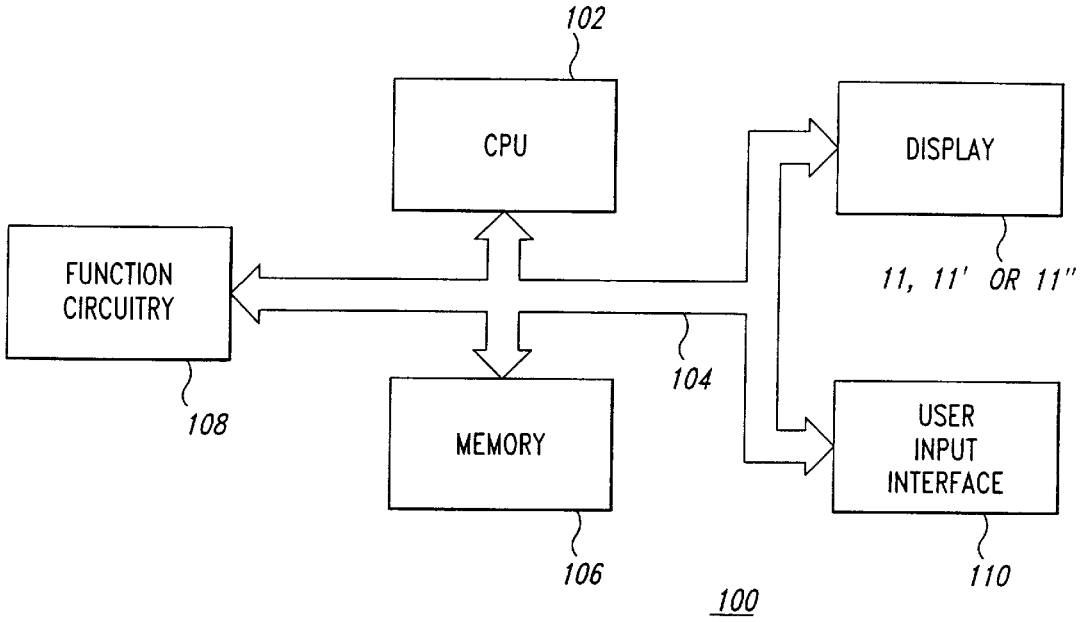
FIG. 7 is a simplified block diagram of a computer including a field emission display using the focusing electrode according to embodiments of the present invention.

FIG. 7 is a simplified block diagram of a portion of a computer 100 including the field emission display 11, 11' or 11" having the focusing electrode 62 as described with reference to FIGS. 2 through 6 and associated text. The computer 100 includes a central processing unit 102 coupled via a bus 104 to a memory 106, function circuitry 108, a user input interface 110 and the field emission display 11, 11' or 11" including the focusing electrode 62 according to the embodiments of the present invention. The memory 106 may or may not include a memory management module (not illustrated) and does include ROM for storing instructions providing an operating system and a read-write memory for temporary storage of data. The processor 102 operates on data from the memory 106 in response to input data from the user input interface 110 and displays results on the field emission display 11, 11' or 11". The processor 102 also stores data in the read-write portion of the memory 106. Examples of systems where the computer 100 finds application include personal/portable computers, camcorders, televisions, automobile electronic systems, microwave ovens and other home and industrial appliances.

Field emission displays 11, 11' or 11" for such applications provide significant advantages over other types of displays, including reduced power consumption, improved range of viewing angles, better performance over a wider range of ambient lighting conditions and temperatures and higher speed with which the display can respond. Field emission displays find application in most devices where, for example, liquid crystal displays find application.

Although the present invention has been described with reference to a preferred embodiment, the invention is not limited to this preferred embodiment. Rather, the invention is limited only by the appended claims, which include within their scope all equivalent devices or methods which operate according to the principles of the invention as described.

What is claimed is:

1. A computer system comprising:

a central processing unit;

a memory device coupled to the central processing unit, the memory device storing instructions and data for use by the central processing unit;

an input interface; and a display comprising:

a baseplate comprising:

a substrate;

a linear array of emitters formed on a surface of the substrate;

a dielectric layer formed on the substrate, the dielectric layer having an opening surrounding each of the emitters;

a conductive extraction grid formed on the dielectric layer, the extraction grid substantially in a plane defined by tips of the emitters and having an opening surrounding a tip of a respective one of the emitters; and an oblong focus electrode surrounding the emitters; and a faceplate comprising:

a transparent insulating viewing surface;

a transparent conductor formed on the transparent viewing surface; and a cathodoluminescent layer formed on the conductive transparent layer.

2. The computer system of claim 1 wherein the focus electrode is electrically coupled to the emitters.

3. The computer system of claim 1 wherein the emitters are arranged in two adjacent rows.

4. The computer system of claim 1 wherein the emitters are staggered between two adjacent rows.

* * * * *